United States Patent [19]

Fujiwara et al.

[11] Patent Number: 4,486,231

[45] Date of Patent: Dec. 4, 1984

[54] DUAL PHASE STAINLESS STEEL SUITABLE FOR USE IN SOUR WELLS

[75] Inventors: Kazuo Fujiwara, Kobe; Haruo Tomari, Hyogo; Osamu Aritomi; Nobuhiro Sato, both of Shimonoseki, all of Japan

[73] Assignee: Kabushiki Kaisha Kobe Seiko Sho, Kobe, Japan

[21] Appl. No.: 492,657

[22] Filed: May 9, 1983

[30] Foreign Application Priority Data

May 13, 1982 [JP] Japan ..... 57-80695

[51] Int. Cl.[3] ..... C22C 38/42

[52] U.S. Cl. ..... 75/125; 75/128 A; 75/128 N; 75/128 W

[58] Field of Search ..... 75/125, 128 A, 128 N, 75/128 W; 148/37

[56] References Cited

U.S. PATENT DOCUMENTS

| | | | |
|---|---|---|---|
| 3,567,434 | 3/1968 | Richardson et al. | 75/125 |
| 4,032,367 | 6/1977 | Richardson et al. | 75/125 |
| 4,055,448 | 10/1977 | Fujikura et al. | 75/125 |

*Primary Examiner*—L. Dewayne Rutledge
*Assistant Examiner*—Debbie Yee
*Attorney, Agent, or Firm*—Oblon, Fisher, Spivak, McClelland & Maier

[57] ABSTRACT

Disclosed herein is a dual phase stainless steel suitable for use in sour wells. It comprises 0.06–0.20% C, ≦1.0% Si, 2.5–4% Mn, 20–27% Cr, 5–8% Ni, 2.5–4% Mo, 0.3–2% Cu, 0.1–0.25% N, 40–60% ferrite and the balance Fe and inevitable impurities. It may further contain one or more metals selected from Ti, Nb and V in a total amount of 0.1% to 0.5%. The dual phase stainless steel is excellent in proof strength, tensile strength and elongation and is capable of exhibiting good corrosion resistance in $Cl^-$—$CO_2$—$H_2S$ environments.

2 Claims, 1 Drawing Figure

DUAL PHASE STAINLESS STEEL SUITABLE FOR USE IN SOUR WELLS

BACKGROUND OF THE INVENTION

1. Field of the Invention

This invention relates to a dual phase stainless steel suitable for use in sour wells, and more particularly to a dual phase stainless steel capable of exhibiting excellent corrosion resistance in $Cl^-$—$CO_2$—$H_2S$ environments and thus suitable for use in sour wells.

2. Description of the Prior Art

Reflecting the scarcity of petroleum resources, deep wells and sour wells which have hitherto been disregarded have been recently given a second look. However, these wells contain lots of chlorides together with $CO_2$ and $H_2S$ in many instances. Accordingly, conventional carbon steel and low alloy steels cannot be used as tubing materials for such wells due to their considerably strong corrosiveness and there is an outstanding demand for high alloy materials having excellent corrosion resistance.

As such high alloy materials, may be mentioned 13Cr martensitic stainless steels, dual phase stainless steels of austenite and ferrite, high nickel austenitic alloys, nickel-base alloys, cobalt-base alloys, titanium-base alloys and the like. Among these alloy materials, a high Cr dual phase austenite/ferrite stainless steel is excellent in general corrosion resistance to $CO_2$ and also resistant against stress corrosion cracking due to chlorides, and has found a wide-spread commercial utility as a tubing material for corrosive wells.

However, the greatest problems of such dual phase stainless steel reside in that it is susceptible of developing sulfide stress corrosion cracking(SSCC) where chlorides and a lot of $H_2S$ are concommitantly present and it involves a danger of developing crevice corrosion and/or pitting corrosion in the concommitant presence of chlorides and $CO_2$. Thus, the development of a dual phase stainless steel durable against these corrosions has been waited for.

Incidentally, the following three characteristics are most important among characteristics generally required for tubing materials to be used in sour wells:

(1) Not to develop stress corrosion cracking in $Cl^-$—$CO_2$—$H_2S$ environments;

(2) Resistant to localized corrosions such as crevice and pitting corrosions in $Cl^-$—$CO_2$—$H_2S$ environments; and (3) To have high mechanical strength.

Of the above important characteristics, it is possible to meet the third requirement for high mechanical strength by cold-working dual phase stainless steel. However, the stress corroding cracking problem referred to in the first requirement becomes extremely easy to occur under such cold-working conditions. Thus, it is desirable to have high mechanical strength under a solution heat treated condition (i.e., annealed).

SUMMARY OF THE INVENTION

The present inventors have found that it is necessary for a dual phase stainless steel as a material for sour wells to enhance its mechanical strength to a considerable extent under a solution heat treated condition, in other words, to increase the C content within a range not deleteriously affecting its corrosion resistant property in order to enhance its mechanical strength under a solution heat treated condition. The above finding was obtained in view of the fact that conventional dual phase stainless steels are have been produced on the assumption that they would be used as welded structures which are different in nature from oil well pipes used in an unwelded state (i.e., screw-coupled state).

Furthermore, the present inventors have also uncovered through experiments that the susceptibility to sulfide stress corrosion cracking in a $Cl^-$—$CO_2$—$H_2S$ environment is significantly affected by the ratio of the austenite content to ferrite content in steel and it is necessary to limit the ferrite content below 60% as shown in FIG. 1. Incidentally, the steel used in FIG. 1 consisted of 0.01–0.21% C, 20–26% Cr, 5–6% Ni, 2–4% Mo, 0–0.5% Cu, 0.1–0.2% N, 0–1% V, and 0–1% Nb. In the diagram, ○ indicates high SSCC resistance whereas ● represents low SSCC resistance.

It has also been found by the present inventors that Cu should be included to enhance the corrosion resistance of austenite phase on the basis of a finding that the crevice corrosion of general dual phase stainless steel in $Cl^-$—$CO_2$—$H_2S$ environments is attributed to preferential corrosion of austenite phase (which preferential corrosion takes place due to lower contents of Cr and Mo in the austenite phase in comparison with their contents in ferrite phase).

The present invention has been completed on the basis of many findings of the present inventors on materials for sour wells while taking the above-described various problems of conventional materials for sour wells and is thus provides a dual phase stainless steel capable of exhibiting excellent corrosion resistance in $Cl^-$—$CO_2$—$H_2S$ environments and thus suitable for use in sour wells.

In one aspect of this invention, there is accordingly provided a dual phase stainless steel suitable for use in sour wells, which steel comprises 0.06–0.20% C, $\leqq$1.0% Si, 2.5–4% Mn, 20–27% Cr, 5–8% Ni, 2.5–4% Mo, 0.3–2% Cu, 0.1–0.25% N, 40–60% ferrite and the balance Fe and inevitable impurities.

In another aspect of this invention, there is also provided a dual phase stainless steel suitable for use in sour wells, which steel comprises 0.06–0.20% C, 1.0% Si, 2.5–4% Mn, 20–27% Cr, 5–8% Ni, 2.5–4% Mo, 0.3–2% Cu, 0.1–0.25% N, 0.1–0.5% one or more metals selected from Ti, Nb and V in total, 40–60% ferrite and the balance Fe and inevitable impurities.

The dual phase stainless steels according to this invention are excellent in proof strength, tensile strength and elongation and are capable of exhibiting good corrosion resistance in $Cl^-$—$CO_2$—$H_2S$ environments. Therefore, they are highly valuable for the industry.

The above and other objects, features and advantages of the present invention will become apparent from the following description and the appended claims, taken in conjunction of the accompanying sole drawing.

BRIEF DESCRIPTION OF THE DRAWINGS

The accompanying sole drawing.

DETAILED DESCRIPTION OF THE INVENTION AND PREFERRED EMBODIMENTS

Figure 1:
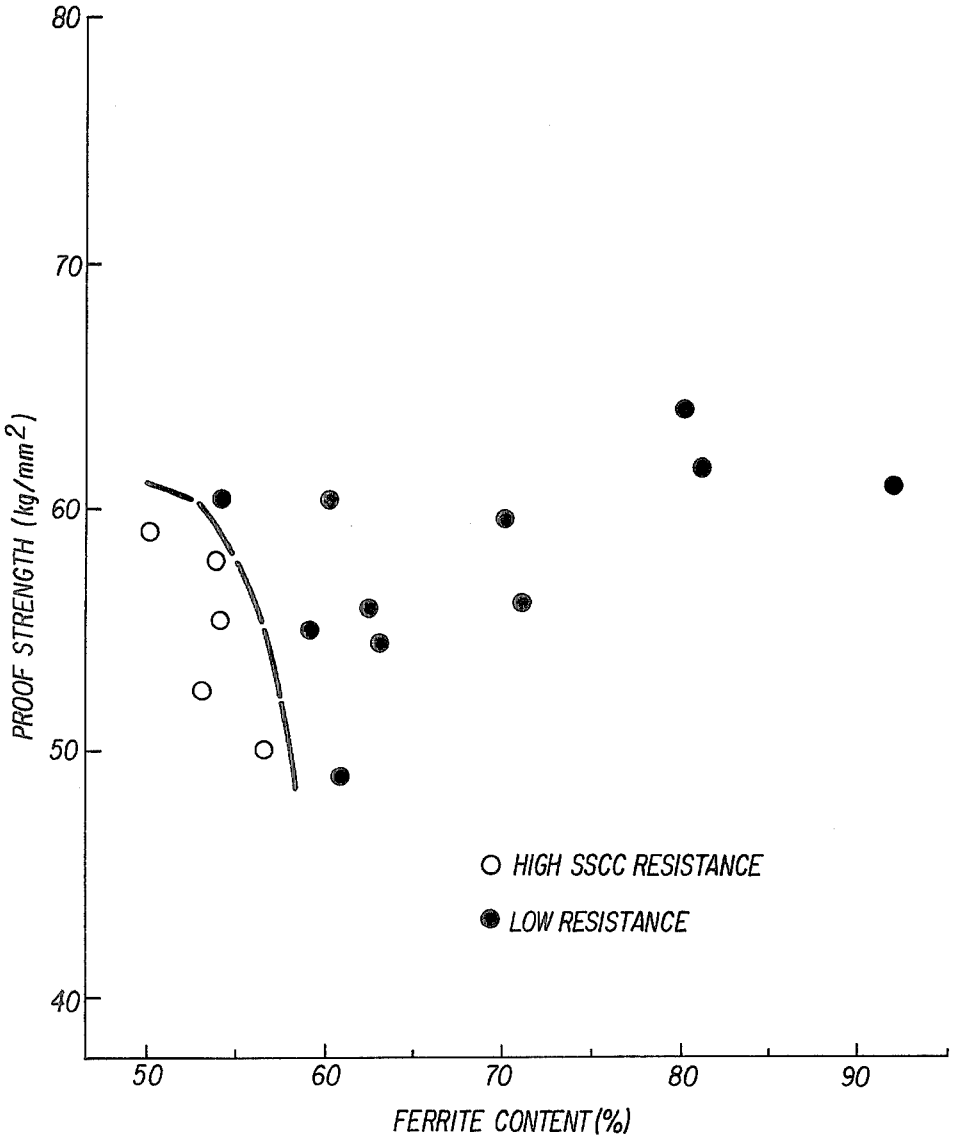
FIG. 1, is a diagram showing the relation between ferrite content and proof resistance as well as their effects on the sulfide stress corrosion cracking.

Dual phase stainless steels according to this invention, which are suitable for use in sour wells, will next be described in detail.

First of all, a description will be made on each of components contained in dual phase stainless steels for sour wells and their proportions.

The element C is added to achieve proof strength of 80 ksi or more which a tubing material for sour wells is required to have under a solution heat treated condition. Its effect is not exhibited at C contents lower than 0.06%, but any C contents in excess of 0.20% will become a cause for intergranular corrosion even under a solution heat trealed condition. Thus, the C content should be controlled within the range of 0.06%–0.20%.

The element Si is an indispensable as a deoxidizer. However, if its content should exceeds 1.0%, the resultant steel will allow a sigma phase to produce in the course of fabrication of tubing for wells, especially during its casting step, whereby making the steel brittle. Thus, the Si content should remain 1.0% or less.

The element Mn is necessary also as a deoxidizer. In addition, it is also effective in increasing the amount of N in solid solution. Thus, it is desirous to add Mn as much as feasible. It is required to add at least 2.5% Mn in order to increase the solid solubility of N. However, any Mn contents in excess of 4% result in deteriorated workability. Accordingly, the Mn content should range from 2.5% to 4%.

It is necessary to add, as a minimum content, 20% Cr in order to obtain resistance to crevice corrosion in $Cl^-$—$CO_2$—$H_2S$ environments. It is also desirous to add Cr as much as feasible. However, any Cr contents exceeding 27% render sigma phases considerably easy to produce, whereby making fabrication of tubing unfeasible. Therefore, it is necessary to control the Cr content within the range of 20–27%.

The element Ni is a strong austenite-forming element. To provide 40% or more austenite phase, it is necessary to incorporate at least 5% Ni although the Ni content may vary in accordance with other components. However, the effect of Ni is saturated at 8% and any additional Ni induces the formation of sigma phase and also results in a price increase. Thus, the Ni content should range from 5 to 8%.

The element Mo is effective to provide resistance to crevice corrosion in $Cl^-$—$CO_2$—$H_2S$ environments when used in combination with Cr. It is necessary to add at least 2% Mo and more Mo is more desirous. However, any Mo contents in excess of 4% make sigma phase easy to form, whereby making fabrication of tubing impossible. Accordingly, the Mo content should be controlled within the range of 2.5–4%.

The element Cu is an important element for enhancing the corrosion resistance of austenite phase in $Cl^-$—$CO_2$—$H_2S$ environments. Its effect will not be sufficiently exhibited when contained in any amounts less than 0.3%. However, any Cu contents in excess of 2% will result in considerably-deteriorated hot workability. Therefore, the Cu content should range from 0.3% to 2%.

The element N serves to enhance the corrosion resistance of austenite phase in $Cl^-$—$CO_2$—$H_2S$ environments similar to Cu and also to increase the mechanical strength of a steel under a solution heat treated condition. To draw out its effects, it is necessary to add N in an amount of 0.1% or more. However, any contents over 0.25% will induce production of bubbles upon casting, whereby making fabrication of tubing impossible. Thus, the N content should be within the range of 0.1–0.25%.

The elements Ti, Nb and V are strong carbide- and nitride-forming elements and, when allowed to precipitate in fine particles, serve to enhance the mechanical strength of a steel under a solution heat treated condition. If their total content should be less than 0.1%, the above-mentioned their effects will not be exhibited. On the other hand, any total contents in excess of 0.5% will reduce the amounts of C and N to be contained as solid solution in matrix, thereby increasing the content of ferrite. Therefore, the total content of two or more of Ti, Nb and V should be controlled within the range of 0.1–0.5%.

By the way, it must be apparent also from the above-given explanation of FIG. 1 why the content of ferrite should be limited below 60%. On the other hand, it is indispensable to contain at least 40% ferrite in order to give proof strength of 80 ksi or higher under a solution heat treated condition.

Next, certain examples of the dual phase stainless steel according to this invention, which are suitable for use in sour wells, will be described together with some comparative examples.

EXAMPLES

Various steels were melted and casted in accordance with the usual ingot-making procedures to contain the components shown in Table 1 at the proportions also given in the same table, followed by their working into specimens.

The mechanical properties, stress corrosion cracking and crevice corrosion of the steels were tested. Test results are summarized in Table 2.

In Table 2, the tensile property was measured in a state treated into solid solution by water-cooling each steel from 1050° C.

On the other hand, the corrosion test was carried out in an aqueous 5% NaCl-0.5% $CH_3COOH$-1 atm $H_2S$ solution at room temperature. U-bend specimens were used in the stress corrosion cracking test while the crevice corrosion test was conducted using flat specimens in each of which a crevice was formed with a TEFLON(-trade mark) washer.

TABLE 1

| Specimen No. | Chemical composition (wt. %) | | | | | | | | | Content of ferrite (%) |
|---|---|---|---|---|---|---|---|---|---|---|
| | C | Si | Mn | Ni | Cr | Mo | Cu | N | Others | |
| | Invention steel | | | | | | | | | |
| 1 | 0.066 | 0.32 | 3.41 | 6.28 | 22.5 | 3.19 | 0.55 | 0.16 | — | 51 |
| 2 | 0.18 | 0.33 | 3.43 | 6.24 | 22.3 | 3.21 | 0.55 | 0.18 | — | 50 |
| 3 | 0.071 | 0.39 | 3.32 | 6.52 | 22.8 | 3.51 | 1.67 | 0.14 | — | 53 |
| 4 | 0.070 | 0.85 | 3.12 | 6.47 | 22.0 | 3.07 | 0.39 | 0.23 | — | 52 |
| 5 | 0.068 | 0.30 | 2.55 | 7.00 | 21.1 | 2.75 | 0.96 | 0.14 | — | 51 |
| 6 | 0.065 | 0.29 | 3.07 | 5.23 | 22.7 | 3.26 | 1.53 | 0.15 | — | 55 |

TABLE 1-continued

| Specimen No. | Chemical composition (wt. %) C | Si | Mn | Ni | Cr | Mo | Cu | N | Others | Content of ferrite (%) |
|---|---|---|---|---|---|---|---|---|---|---|
| 7 | 0.073 | 0.25 | 3.04 | 6.51 | 21.8 | 3.77 | 0.45 | 0.19 | V: 0.41 | 54 |
| 8 | 0.072 | 0.24 | 3.05 | 6.51 | 21.9 | 3.80 | 0.41 | 0.20 | V: 0.20, Nb: 0.20 | 56 |
| 9 | 0.073 | 0.26 | 3.03 | 6.50 | 22.0 | 3.78 | 0.43 | 0.18 | Ti: 0.15, Nb: 0.05 | 55 |
| 10 | 0.063 | 0.34 | 3.88 | 7.83 | 25.6 | 2.99 | 0.85 | 0.17 | — | 52 |
| 11 | 0.062 | 0.34 | 3.14 | 7.52 | 26.7 | 3.01 | 0.51 | 0.13 | — | 54 |
| 12 | 0.061 | 0.35 | 3.37 | 7.05 | 24.8 | 2.55 | 1.57 | 0.11 | Nb: 0.15, V: 0.18 | 54 |
| | | | | | | Comparative steel | | | | |
| 13 | 0.013 | 0.35 | 1.56 | 6.15 | 21.5 | 3.06 | — | 0.15 | V: 0.23 | 62 |
| 14 | 0.066 | 0.46 | 2.83 | 5.10 | 25.2 | 3.58 | — | 0.16 | — | 77 |
| 15 | 0.021 | 0.36 | 0.54 | 5.99 | 20.4 | 1.92 | — | — | Ti: 0.30 | 60 |

TABLE 2

| Specimen No. | Tensile properties under a solution heat treated condition: Proof strength ($kg/mm^2$) | Tensile strength ($kg/mm^2$) | Elongation (%) | Corrosion resistance in $Cl^-$—$CO_2$—$H_2S$ solution: Stress corrosion cracking | Crevice corrosion* |
|---|---|---|---|---|---|
| | | | Invention steel | | |
| 1 | 57.3 | 80.4 | 27.4 | good | good (2.2) |
| 2 | 60.2 | 84.0 | 25.4 | good | good (2.0) |
| 3 | 57.5 | 81.2 | 26.6 | good | good (1.8) |
| 4 | 58.4 | 81.0 | 26.8 | good | good (2.1) |
| 5 | 56.9 | 82.1 | 28.5 | good | good (2.7) |
| 6 | 56.8 | 81.3 | 27.6 | good | good (2.0) |
| 7 | 57.7 | 82.2 | 27.3 | good | good (1.8) |
| 8 | 59.1 | 83.7 | 25.8 | good | good (1.8) |
| 9 | 60.3 | 84.6 | 26.3 | good | good (1.9) |
| 10 | 58.1 | 82.3 | 25.6 | good | good (1.1) |
| 11 | 60.5 | 85.1 | 24.8 | good | good (1.3) |
| 12 | 61.2 | 85.6 | 25.1 | good | good (1.2) |
| | | | Comparative steel | | |
| 13 | 55.3 | 78.9 | 32.3 | poor | poor (10.2) |
| 14 | 56.0 | 80.3 | 27.8 | poor | poor (7.3) |
| 15 | 50.1 | 66.5 | 40.0 | poor | poor (25.4) |

*Numerals in brackets indicate extents of corrosion in μm/year.

As apparent from Table 2, the dual phase stainless steels according to this invention, which are suitable for use in sour wells, were superior in proof strength, tensile strength and elongation and far superior in corrosion resistance in the $Cl^-$—$CO_2$—$H_2S$ solution in comparison with the comparative steels. Thus, it is clear that dual phase stainless steels according to this invention, which are suitable for use in sour wells, have an excellent industrial value.

Having now fully described the invention, it will be apparent to one of ordinary skill in the art that many changes and modifications can be made thereto without departing from the spirit or scope of the invention as set forth herein.

What is claimed is:

1. A dual phase stainless steel suitable for use in sour wells, consisting essentially of 0.06–0.20% C, ≦1.0% Si, 2.5–4% Mn, 20–27% Cr, 5–8% Ni, 2.5–4% Mo, 0.3–2% Cu, 0.1–0.25% N, 40–60% ferrite and the balance Fe and inevitable impurities.

2. A dual phase stainless steel suitable for use in sour wells, consisting essentially of 0.06–0.20% C, ≦1.0% Si, 2.5–4% Mn, 20–27% Cr, 5–8% Ni, 2.5–4% Mo, 0.3–2% Cu, 0.1–0.25% N, 0.1–0.5% one or more metals selected from Ti, Nb and V in total, 40–60% ferrite and the balance Fe and inevitable impurities.

* * * * *